United States Patent [19]

Daly et al.

[11] 4,011,059

[45] Mar. 8, 1977

[54] SELF-CENTERING TRAVERSING STIRRER SHAFT FOR FIXED BED GASIFIER

[75] Inventors: John W. Daly, Quaker Street; Kenneth A. Darrow, Sprakers, both of N.Y.

[73] Assignee: General Electric Company, Schenectady, N.Y.

[22] Filed: Jan. 30, 1976

[21] Appl. No.: 653,917

[52] U.S. Cl. ..... 48/85.2; 48/63; 48/73; 48/86 R; 259/107; 432/233

[51] Int. Cl.[2] ..... C01J 3/32

[58] Field of Search ..... 48/85.2, 74, 63, 77, 48/73, 86 R; 432/233; 259/107; 222/229; 233/6, 3

[56] References Cited

UNITED STATES PATENTS

| | | | |
|---|---|---|---|
| 1,415,433 | 5/1922 | Engel | 259/107 |
| 1,679,645 | 8/1928 | Bentley et al. | 48/85.2 |
| 1,806,614 | 5/1931 | Culbertson | 48/85.2 |
| 2,689,786 | 9/1954 | Hubmann | 48/77 |

*Primary Examiner*—Robert L. Lindsay, Jr.
*Assistant Examiner*—George C. Yeung
*Attorney, Agent, or Firm*—Leo I. MaLossi; Joseph T. Cohen; Jerome C. Squillaro

[57] ABSTRACT

Stirrer construction adapted for both vertical and rotational movements is described for use in a fixed bed coal gasifier. Rabble arms projecting from a depending shaft are arranged as an upper and a lower set. The rabble arms in the lower set each present shear edges at and adjacent the tips thereof in order to be lowered into the ash zone, when desired, to break away the hard sintered masses that tend to develop along the wall there. Also, the lower set of rabble arms is designed for use in the combustion ("hot") zone to break up or loosen clinker formation with minimum damage to the ceramic liner in this portion of the gasifier. The rabble arms in the upper set are longer than the rabble arms in the lower set and extend closer to the wall of the gasifier being used both in order to center the stirrer shaft and to stir the upper regions of the coal bed.

6 Claims, 3 Drawing Figures

SELF-CENTERING TRAVERSING STIRRER SHAFT FOR FIXED BED GASIFIER

BACKGROUND OF THE INVENTION

Fixed bed coal gasifiers have been known and used for many years. Successful operation thereof has depended upon the use of non-caking coals or coke to accomplish the gasification. The instant invention is directed to an improvement in the coal gasification apparatus whereby the detrimental effects of using coals of high swelling and caking index are, at least in part, offset.

In the fixed bed coal gasification process, as the coal enters the gasifier at the top and lands on the top of the charge, it receives heat from the upwardly-moving product gas. As the combustion process near the bottom of the gasifier consumes some of the coal and the rest of the coal is gasified, coal at the top of the charge gradually moves down passing through a series of treatment states: initial heating; devolatilization and coking; gasification, and carbon oxidation. A large number of chemical reactions occur and a minimum temperature ofabout1700–1900Fis°required. When air and steam are introduced to the combustion zone, the end product is producer gas; when oxygen and steam are employed, the end product is synthesis gas.

In the typical coal gasifier the feed is nitroduced into the gasifier by means of a charging lock arrangement and the ash is removed by means of a discharge lock. Each lock is provided with closure arrangements.

An improved coal gasification process in which finely divided coal with a binder is extruded into the coal gasifier with the gasifier being operated at elevated pressures is described in copending U.S. patent application Ser. No. 526,228 — Furman, filed Nov. 22, 1974, now abandoned, and assigned to the instant assignee. The construction utilized in the latter invention considerably decreases the headroom required in the building housing the gas generator and eliminates the problem of disposing of the made gas entering the charging lock during coal feed via a charging lock arrangement.

A fuel-bed agitator or stirrer construction consisting of a vertically mounted rotating shaft to which are affixed three pairs of horizontally extending arms, or rabbles, vertically disposed two feet apart is disclosed in Bureau of Mines Report of Investigations 7644 "Strongly Caking Coal Gasified in a Stirred-Bed Producer", Lewis et al., U.S. Department of the Interior (1972). The agitator construction is shown in FIG. 2 on page 4 of the report. The Bureau of Mines report is incorporated by reference with respect to its disclosure of a gas producer equipped with a stirrer and means for affecting vertical and rotational motion thereof.

Deflection of the distal end of the shaft in such an arrangement can occur by the imposition of a relatively small (e.g., 100 pounds) of side thrust such that the lower rabble arms will be brought into contact with the wall and, if the wall were to be made of ceramic brick, a relatively soft material, the rabble arms would dig into and damage the brick wall. When the portion of the gasifier wall in which such damage could occur is made of water-cooled metal, as is shown in FIG. 3 of the Bureau of Mines report, damage is minimal.

However, in using a water-cooled wall, certain disadvantages accrue; namely, the coal adjacent the cooled wall is not properly gasified and may enter the ash zone before suitable decomposition thereof. In this condition in addition to decreasing the efficiency of the gasification, the coal promotes the development of large slag-like clinker deposits affixed to the walls that are difficult to break up in order to discharge the ash through the grate. Thus, it would be of advantage to be able to use a depending stirrer construction of the general configuration illustrated in the Bureau of Mines report, but have the gasifier wall made of ceramic. It is to the solution of this problem that the instant invention is addressed.

DESCRIPTION.OF THE INVENTION

Stirrer construction adapted for both vertical and rotational movements is described for use in a fixed bed coal gasifier. Rabble arms projecting from a depending shaft are arranged as an upper and a lower set. The rabble arms in the lower set each represent shear edges at and adjacent the tips thereof in order to be lowered into the ash zone, when desired, to break away the hard sintered masses that tend to develop along the wall there. Also, the lower set of rabble arms is designed for use in the combustion ("hot") zone to break up or loosen clinker formation with minimum damage to the ceramic portion of the gasifier. The rabble arms in the upper set are longer than the rabble arms in the lower set and extend closer to the wall of the gasifier being used both in order to center the stirrer shaft and to stir the upper regions of the coal bed.

BRIEF DESCRIPTION OF THE DRAWING

The subject matter of the instant invention for which protection is sought is presented as claims at the conclusion of the written description of the invention set forth herein. The description sets forth the manner and process of making and using the invention and the accompanying drawing forms part of the description schematically illustrating the preferred embodiment. The view shown in FIG. 1 shows a cutaway view in section of the interior of a coal gasifier;

MANNER AND PROCESS OF MAKING AND USING THE INVENTION

Figure 1:
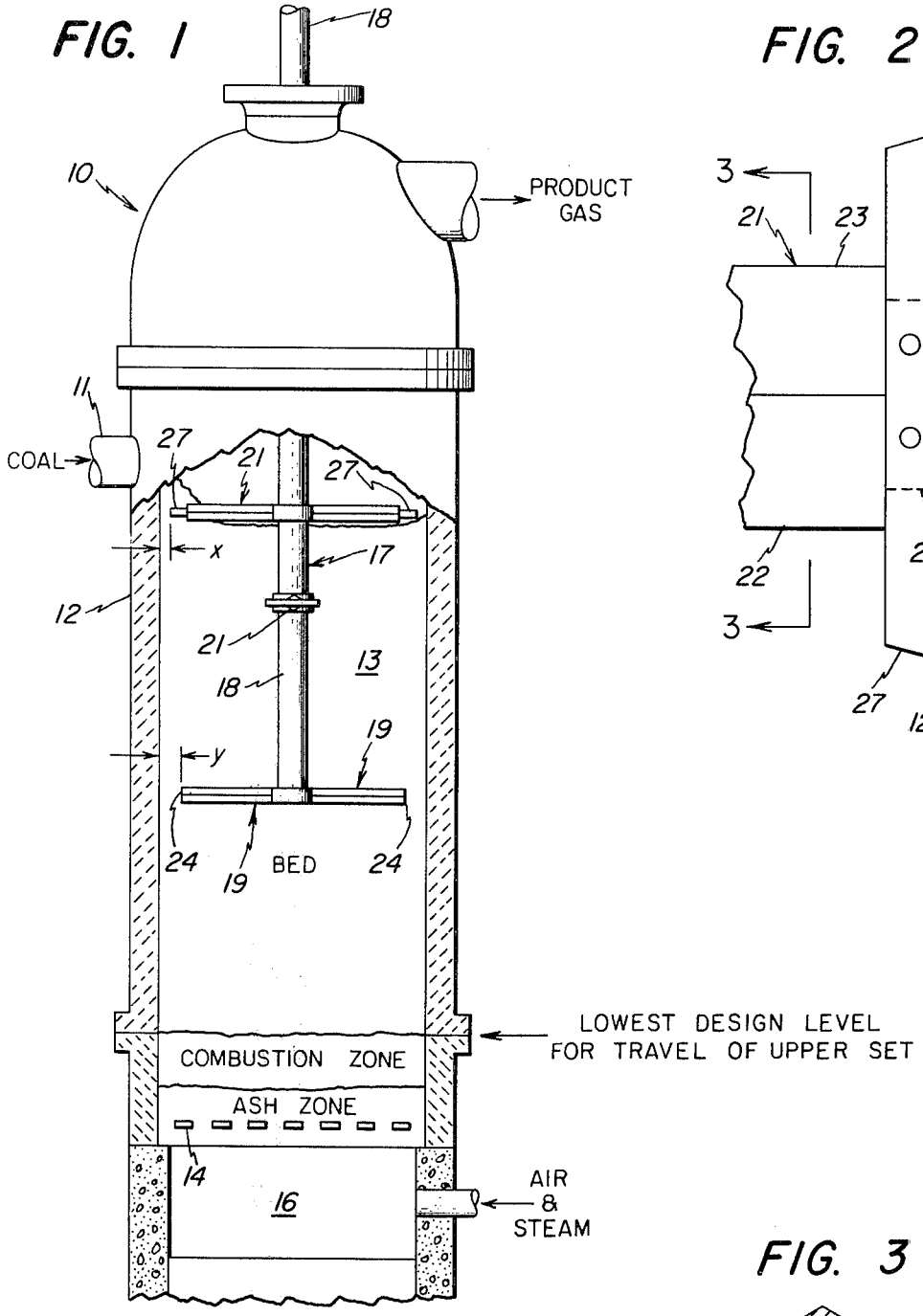

The embodiment described hereinbelow is the best mode contemplated of this invention.

The refractory-lined gas generating volume of gasifier 10 is equipped to receive its fuel charge in the form of rod-like briquettes from extruder 11. A mixture comprising particulate coal of low moisture content and pitch particles is formed into a rod-shaped extrudate of substantially uniform composition in passage through extruder 11 into the volume enclosed within refractory-lined wall 12 as is described in greater detail in the aforementioned Furman application.

The emerging extrudate rod is subdivided and is deposited by gravity upon coal charge 13.

As the charge moves down toward the combustion zone and is burned, an ash bed accumulates over the vertically and rotationally movable grate 14, which supports the superimposed charge or bed, until the ash is discharged through the grate to drop via manifold 16 into a lock hopper ash collection system (not shown).

The air-steam input to the gasifier may be premixed or may be introduced into manifold 16 separately. This gaseous input in combination with the coal, results in a product gas composition having the following approximate analysis:

| GAS | % by volume |
|---|---|
| $H_2$ | 15 |
| CO | 25 |
| $CH_4$ | 5 |
| $CO_2$ | 10 |
| $N_2$ | 45 |
| | 100% |

The outgoing product gas is passed through a water scrubber (not shown) in which the tar and pitch content thereof is condensed. After treatment this pitch may be recirculated to provide the briquette binder material.

The ability of the binder to wet the particles of coal (and any particulate additives that may be employed) to bind them together is particularly important in the case of the extrusion charging of coal into a pressurized gas producer, because good internal adhesion will prevent the formation of cracks along the extrudage (e.g., at the extrudate/extruder barrel interface). If such cracks develop, the pressure differential between the gasifier and the atmosphere will not be maintained.

Particularly when caking coals are employed to charge the gasifier it becomes necessary to provide a stirring action to coal bed 13 to break up coal agglomerates and maintain uniform bed porosity to optimize gas-solid contact. As is described in the aforementioned Bureau of Mines report, this is the purpose of utilizing a fuel-bed agitator, or stirrer, as described therein.

It is also desirable that this same stirrer device be provided with the capability of breaking up or breaking loose from wall 12 the very hard slag-like clinkers that form in and below the combustion zone of the gasifier. Conventional means, not shown, would be employed to move stirrer device 17 vertically and rotationally and, similarly, conventional means, not shown, would be employed to move grate 14 vertically and rotationally.

The instant invention contemplates the capability for overlapping the vertical traverse of stirrer device 17 and grate 14 in the sense that a portion of the lower volume of gasifier 10 can be selectively serviced by either the stirrer device 17 or grate 14.

When the shaft 18 is rotated, stirring of the coal bed 13 is accomplished by rabble arms affixed to and extending from the central shaft 18. These rabble arms are divided into two sets, a lower set and an upper set, each set having specific capabilities.

In the preferred construction, the lower set of rabble arms consists of two arms 19, 180° apart, traversing in substantially the same plane. The upper set consists of four rabble arms 21 divided into two tiers of two arms 21, 180° apart, with the arms 21 in each tier traversing in a different substantially horizontal plane.

Figure 3:
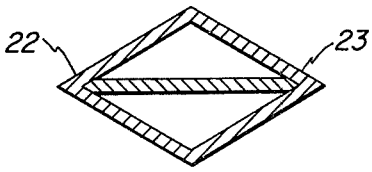
FIG. 3 is a section taken on line 3—3 of FIG. 2 showing the generally airfoil-shaped cross-section used for all of the rabble arms. The cross-section is continued to the distal end of each of the lower set of rabble arms in order to provide a shearing edge at and adjacent the tip thereof.

The overall construction of rabble arms 19 and 21 differ, because the demands placed upon these rabble arms are different. In order to carry on the bed stirring function when stirrer 17 is positioned so that all of the rabble arms are above the combustion zone, primary reliance is placed upon the generally airfoil-shape with featheredges of the shank of each rabble arm. This shape is shown in FIG. 3. The particular relationship between this shank configuration and the stirring mode under discussion is the capability provided so that along any given plane of rotary motion, each rabble arm will separate the coal bodies it encounters at the leading edge (edge 22 or edge 23, depending upon the direction of rotation), force the coal bodies so separated apart as the thicker portions of the shank pass and then permit the rearranged coal bodies to gradually merge at the trailing edge of the passing arm. In this manner there is a temporary dislocation of the coal bodies to break up agglomerates, but each locus is left in a uniform state after traversal of the shank therethrough.

Figure 2:
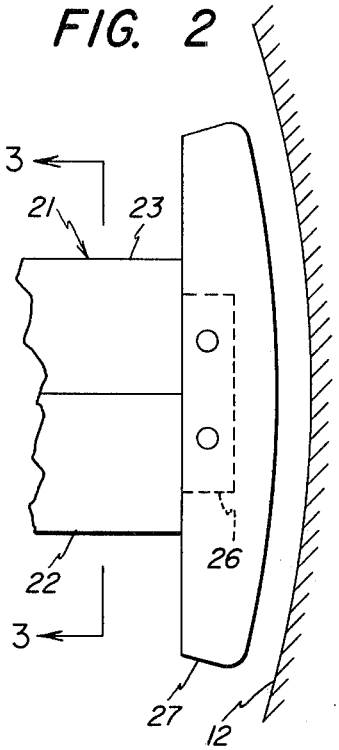
FIG. 2 is representative of a properly shaped rabble arm tip employed on each of the arms in the upper set.

In the case of lower rabble arms 19, the shape shown in FIG. 3 prevails all the way to the distal ends thereof providing shearing edges at the tips 24 for use in the clinker destruction mode to be described hereinbelow. In the case of rabble arms 21, removable tips are affixed to the arm shanks as is shown in greater detail in FIG. 2. Since shaft 18 and the interiors of each rabble arm shank are formed hollow in order to accommodate the circulation of cooling water, the end of each shank must be cooled. In the case of rabble arms 21 the closure plate is provided with a projecting tongue 26 designed to fit into a suitable recess in shoe 27 forming the tip of enlarged area for each of these arms.

It is not unusual to provide replaceable rabble arm portions, but the shoes 27, which are provided only for upper set rabble arms 21 in accordance with this invention are designed (i.e., have the requisite contact area, greater than the face area of the colsure plate, so as to obviate digging into the wall) to perform a specific function, the provision of the rough equivalent of a bearing support for downwardly depending shaft 18. This bearing function is further facilitated by the arrangement of the rabble arms 21 in the upper set so that the rabble arms 21 in the two tiers are angularly offset, the four rabble arms 21 being 90° apart (i.e., viewed in plan).

When the stirring mode is such that stirrer 17 has been moved downwardly until rabble arms 19 are made to enter and even pass through the combustion zone to enter the ash zone, the shearing tips 24 strike against clinker formations adhering to and projecting from the inner surface of wall 12 in these regions. However, since shaft 18 is firmly supported only at the upper end thereof where it enters gasifier 10 via a bearing (not shown) construction, when a tip 24 strikes against a hard unyielding clinker formation, the unsupported shaft 18 will deflect. Prior art agitator devices such as the device shown in the Bureau of Mines report (FIG. 2) are unable to provide any restraint to such deflection and, as a result, if the wall 12 were of ceramic construction, the rabble arms would dig into the walls and eventually cause destruction thereof.

In contrast thereto, the instant invention utilizes the upper set of rabble arms to perform a new function. This is accomplished by setting criteria for the clearance between the inner surface of wall 12 and the tips of rabble arms 21 (dimension $x$) relative to the clearance between the inner surface of wall 12 and the tips 24 of rabble arms 19 (dimension $y$). Thus, by requiring that dimension $y$ be at least ½ inch greater than dimension $x$, if a tip 24 of a rabble arm 19 strikes any obstruction, the resulting increase in torque can deflect shaft 18 only until one or more of shoes 27 comes in contact with wall 12. The requisite clearance criteria are most easily met by making arms 19 shorter than arms 21 (e.g., by at least ½ inch). The inner surface of wall 12 remains relatively clean and smooth above the combustion zone and as the shear edge of tip 24 repeatedly strikes projecting clinkers and is deflected until the clinkers are dislodged and broken, the upper rabble arms merely "walk" around the inner wall surface and the tips 24 are kept clear of the gasifier wall preventing damage thereto.

In this manner, the invention provides with the upper two tiers of rabble arms the rough equivalent of a bottom bearing for shaft 18. The actual use of a bottom bearing is foreclosed, because of the expense of building and maintaining such a device and because, since such a bearing would have to be installed below grate 14, a portion of shaft 18 would always have to pass through the hot zone.

In the preferred arrangement a spacing of about 3 feet is set between rabble arms 19 and the lower tier of rabble arms 21 and a spacing of 12 inches is provided between the two tiers of arms in the upper set. By dividing the upper set into two tiers, excessive stirring of the coal in a single plane of the gasifier bed is avoided and as it becomes necessary for arms 21 to walk on wall 12, each will follow its own path, minimizing wall wear.

By moving stirrer 17 to the proper level the rabble arms 21 in the upper set may be used to level off the top of the coal bed 13.

What we claim as new and desire to secure by Letters Patent of the United States is:

1. In apparatus for generating a gas mixture containing combustible components wherein a closed vertically extending vessel is provided with means mounted in the lower region of the interior of said vessel for supporting a bed of solid fuel thereon, first conduit means in flow communication with said interior of said vessel below said supporting means for introducing gas flow into said vessel, second conduit means in flow communication with the upper region of said interior of said vessel for removing product gas therefrom, means in flow communication through the exterior of said vessel with said upper region for introducing solid fuel bodies therein and liquid-cooled means for stirring said bed of solid fuel, said stirring means being adapted for vertical and rotational motions and comprising a depending vertically disposed shaft having a plurality of rabble arms extending from said shaft toward the inner surface of the wall of said vessel, the improvement comprising:

said plurality of rabble arms being divided into a lower set and an upper set, said lower set including at least two arms of substantially equal length angularly disposed relative to each other and said upper set including at least four arms of substantially equal length angularly disposed relative to each other, the arms of said upper set being longer than the arms of said lower set whereby the distal end of each arm in said upper set is at least one-half inch closer to said inner surface of said wall than the distal end of each arm in said lower set and each arm of said lower set being formed with at least one shearing edge at and adjacent the distal end thereof while each arm of said upper set only has the distal end thereof shaped to present an enlarged area for contact with the inner surface of the wall of the gasifier in the event of lateral deflection of the shaft.

2. The apparatus of claim 1 wherein in the improvement the upper set has rabble arms disposed in two tiers having at least two rabble arms in each tier, said tiers being spaced closer together vertically than the vertical spacing between the lower of said tiers and the lower set.

3. The apparatus of claim 2 wherein in the improvement the upper set contains four rabble arms.

4. The apparatus of claim 2 wherein in the improvement the rabble arms in the two tiers are disposed in parallel planes.

5. The apparatus of claim 1 wherein in the improvement each arm in the lower set is formed in a generally airfoil-shaped cross-section with feathered edges on both the leading and trailing edges thereof.

6. The apparatus of claim 1 wherein in the improvement the shank portion of each arm in the upper set is formed in a generally airfoil-shaped cross-section with featheredges on both the leading and trailing edges thereof.

* * * * *